United States Patent [19]

Alexander et al.

[11] Patent Number: 4,517,629

[45] Date of Patent: May 14, 1985

[54] MOTOR VEHICLE HEADLIGHT WITH ADHESIVE ACCUMULATION MEANS

[75] Inventors: Kenneth E. Alexander; Robert J. Marshall, both of Seymour, Ind.

[73] Assignee: GTE Products Corporation, Stamford, Conn.

[21] Appl. No.: 459,272

[22] Filed: Jan. 19, 1983

[51] Int. Cl.[3] ..... F21V 31/02

[52] U.S. Cl. ..... 362/267; 362/306; 313/331; 313/113

[58] Field of Search ..... 313/331, 332, 113, 315; 362/306, 267, 308; 156/295, 424, 423

[56] References Cited

U.S. PATENT DOCUMENTS

| | | | |
|---|---|---|---|
| 4,181,869 | 1/1980 | Warren et al. | 313/113 X |
| 4,300,189 | 11/1981 | Shanks | 362/267 |
| 4,310,772 | 1/1982 | Tyler et al. | 313/113 |
| 4,425,606 | 1/1984 | Shanks et al. | 313/113 X |
| 4,425,607 | 1/1984 | Shanks | 313/113 X |
| 4,456,947 | 6/1984 | Alexander | 362/267 |

*Primary Examiner*—Deborah L. Kyle
*Assistant Examiner*—John S. Maples
*Attorney, Agent, or Firm*—Lawrence R. Fraley

[57] ABSTRACT

A motor vehicle headlight wherein plastic reflector and lens components are utilized to house a tungsten-halogen lamp capsule therein. Forming part of the rear portion of the plastic reflector is an upstanding portion for each of the headlight's terminal means. Each upstanding portion includes a surface for having the metallic lug member of the terminal means positioned thereon. Located within an upper part of the upstanding portion is an annular reservoir which surrounds the opening through which a support wire of the lamp capsule component passes. This reservoir is designed for accumulating excess quantities of adhesive used during headlight assembly, particularly during the operation where the lug member is mechanically secured to a metal eyelet which also forms part of the terminal means.

5 Claims, 3 Drawing Figures

MOTOR VEHICLE HEADLIGHT WITH ADHESIVE ACCUMULATION MEANS

CROSS REFERENCE TO COPENDING APPLICATION

In Ser. No. 385,998, filed June 7, 1982, there is described a glass headlight wherein the lug member utilized therein defines a reservoir to trap and contain excess adhesive during assembly of the headlight. This lug design may also be utilized with the instant invention defined herein, if desired. Ser. No. 385,998 is now U.S. Pat. No. 4,456,947 and entitled "Motor Vehicle Headlight With Contact Lug Defining Adhesive Reservoir" (Inventor: Kenneth E. Alexander).

TECHNICAL FIELD

The present invention relates in general to headlights and particularly to those of the automotive (motor vehicle) variety. Even more particularly, the present invention relates to motor vehicle headlights wherein the reflector and lens components are of a plastic material.

BACKGROUND

Motor vehicle headlights having a plastic reflector and lens secured thereto have been recently introduced and provide several advantages over existing headlights wherein the reflector and lens components are comprised of glass. Examples are shown in U.S. Pat. Nos. 4,344,120 (Bradley et al), 4,342,142 (Nieda et al), 4,280,173 (Bradley et al), 4,210,841, (Vodicka et al) and 4,181,869 (Warren et al). One particular advantage of a plastic headlight wherein a tungsten-halogen capsule is utilized as the light source is a significant savings in weight. For example, a savings of approximately three pounds over a standard glass, four headlight system has been realized when using four corresponding plastic headlights. In addition, it has been determined that a plastic lens transmits from about ten to about fifteen percent more light than a glass lens because it is possible to mold a plastic (e.g., polycarbonate) lens with sharper (more precise) optics than is possible when molding glass. In addition to the above, plastic headlamps utilizing a tungsten-halogen capsule as the light source have been shown to save approximately five amperes of electricity when operated in the low beam mode.

During manufacture of plastic headlights of the type described above (those having a tungsten-halogen capsule), it is necessary to firmly position the capsule within the headlight relative to the reflector's internal reflecting surface. This is typically done by utilization of at least two (and sometimes three) support wires which in turn are connected to the lamp capsule, either to the lead-in wires extending from the capsule or to a suitable conductive retainer fitted over the capsule's press-sealed end. The support wires in turn penetrate the rear portion of the reflector through a corresponding plurality of openings located therein. A metallic eyelet member is often inserted within the opening and joined to a corresponding metallic lug member located externally of the reflector and designed for providing electrical connection to an external source (e.g., an electrical connector forming part of the motor vehicle's wiring system). One specific example of such an arrangement is the headlight shown and described in the aforementioned U.S. Pat. No. 4,181,869 (Warren et al), said patent assigned to the same assignee as the instant invention.

Also during the above assembly, an adhesive such as an epoxy resin in a paste-like or semi-liquid form is dispensed into the described openings in the rear of the plastic reflector in order to provide improved sealing of the reflector to the aforementioned metallic lug and eyelet. Because of manufacturing variations in the size of the reflector's openings which are to be filled, as well as manufacturing variations in the assembly process, the proper amount of adhesive necessary to fill the respective openings varies from lamp to lamp. During the manufacturing process, to be safe, it is thus preferred to dispense more (excess) adhesive than might be needed. Therefore, when the lug is fastened to the eyelet, the excess adhesive is often squeezed out to the outside edges of the lug and occasionally onto the back surface of the reflector. This in turn causes problems both in handling and additional processing of the headlight through the remainder of the assembly procedure. For example, there can often be a charring of the excess adhesive which occurs during a subsequent soldering step, resulting in an unsightly appearance of the finished product. In addition, excess adhesive can cause "bad solder" defects due to its presence on surfaces of the lug and/or eyelet which eventually receive the solder employed on headlights to secure the headlight's lead-in support wire relative to the eyelet and contact lug members.

It is believed, therefore, that a motor vehicle headlight which incorporates therein a new and unique means for accommodating for excess adhesive used during manufacturing thereof would constitute an advancement in the art.

DISCLOSURE OF THE INVENTION

Accordingly, it is a primary object of the present invention to provide a motor vehicle headlight wherein improved containment of excess adhesive used during manufacture of the headlight is made possible during said manufacture.

To accomplish the foregoing and other objects of this invention, there is provided a motor vehicle headlight which comprises a plastic reflector having a curved rear portion and a forward open end portion, a lens secured to the reflector, an electric lamp (e.g., tungsten-halogen) disposed within the reflector and including a glass envelope, at least two lead-in wires projecting from the envelope and at least two support wires, each being fixedly secured to a respective one of the lead-in wires and each passing through respective openings within the reflector's rear portion, and terminal means for being connected electrically to at least one of the support wires. The terminal means includes a metallic eyelet located within one of the reflector's openings and a metallic lug member having a base segment and an upstanding leg segment, said eyelet being secured to the base segment. The curved rear portion of the reflector includes an upstanding portion located about the opening having the eyelet therein. Located within an upper surface of the upstanding portion is a reservoir designed for accommodating excessive amounts of adhesive which can occur during assembly of the headlight.

BEST MODE FOR CARRYING OUT THE INVENTION

For a better understanding of the present invention, together with other and further objects, advantages and capabilities thereof, reference is made to the following disclosure and appended claims in connection with the above described drawings.

Figure 1:
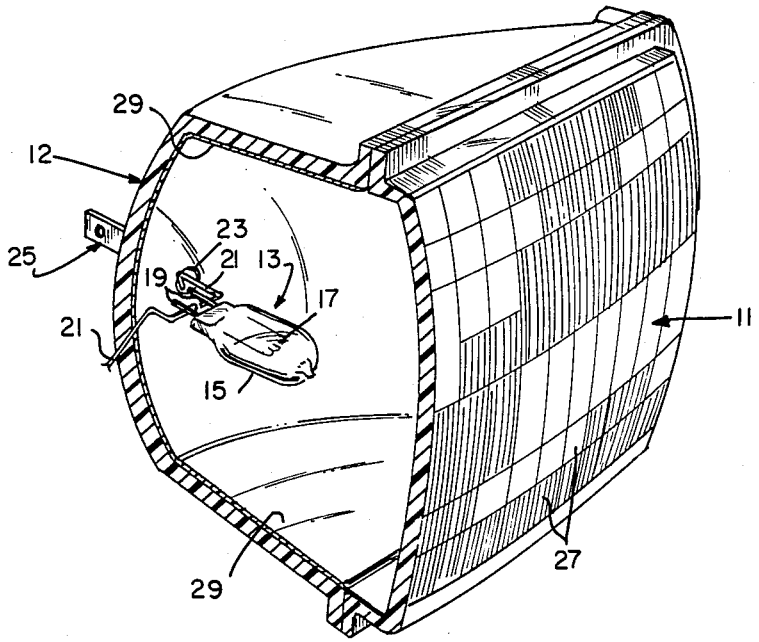
FIG. 1 is a partial perspective view of a motor vehicle headlight in accordance with one embodiment of the invention.

A motor vehicle headlight in accordance with a preferred embodiment of the instant invention is shown in FIG. 1 and comprises a plastic (e.g., polycarbonate) lens 11 bonded to the front of a curved, usually parabolic, plastic (e.g., polycarbonate) reflector 12 and in which a tungsten-halogen lamp capsule 13 is disposed. Lamp capsule 13 can be a hardglass type of tungsten-halogen lamp, as shown, for example, in U.S. Pat. No. 3,829,729 (Westlund et al). Lamps of this type typically include a glass envelope 15 having therein a specific filament structure 17 which, when energized, provides the required light output for the capsule. Lamp capsule 13 may include a singular filament or alternatively, a pair of spaced filaments should it be desirable to provide both high and low beams from a single headlight. Understandably, dual filament tungsten-halogen lamp capsules are employed in motor vehicle lighting systems wherein only two headlights are utilized, whereas single filament capsule types of headlights are employed in four lamp arrangements wherein each pair provides the low and high beams, respectively.

Projecting from the sealed end of envelope 15 is a pair of metal lead-in wires 19 which in turn are each positively connected (e.g., welded) to a corresponding, metal support wire 21. Each of the support wires passes through a corresponding opening 23 (only one shown in FIG. 1) located within the rear portion of the plastic reflector. As will be described below, each support wire is in turn connected to a terminal means to thus provide an efficient means for electrically connecting the headlight of the instant invention to the corresponding electrical circuitry of the motor vehicle in which the invention is utilized. As will also be described below, each terminal means includes at least one lug member 25 for effecting the aforementioned connection (e.g., to a connector forming part of the vehicle's electrical circuitry).

As shown in FIG. 1, lens 11 includes a plurality of individual lens elements 27 designed for directing light from lamp 23 therethrough to produce a pre-established pattern. Accordingly, it is seen that reflector 12 includes a forward open end portion through which said light passes and to which is secured the rectangular lens 11. Lens 11 thus provides a closure for the reflector's open end. An internal reflective coating 29 (e.g., aluminum) is provided on the reflector's internal surfaces to reflect light in the desired direction toward lens 11 and thus enhance output of the instant invention.

Figure 2:
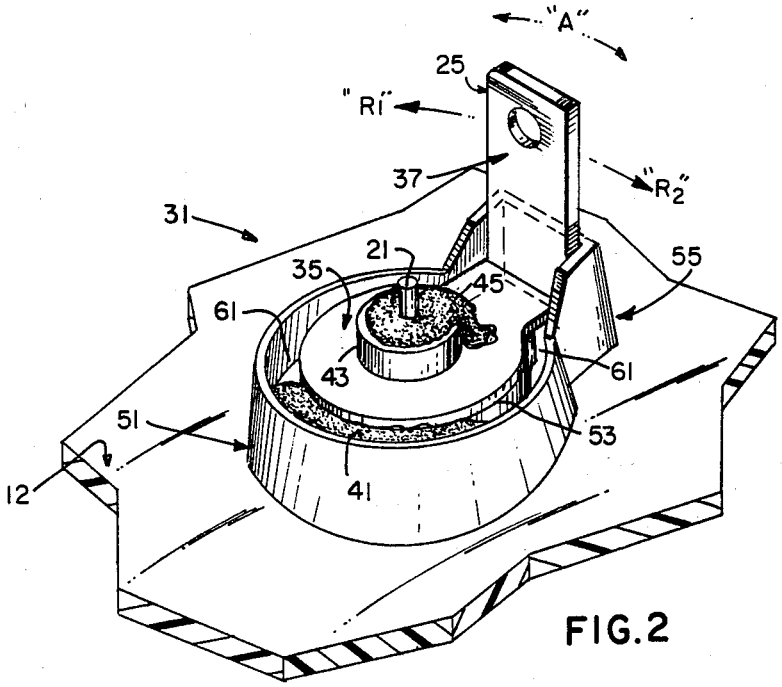
FIG. 2 is a partial perspective view of a terminal means for use with the headlight shown in FIG. 1 and illustrating a preferred embodiment for accommodating excessive adhesive which may occur during manufacture thereof.
Figure 3:
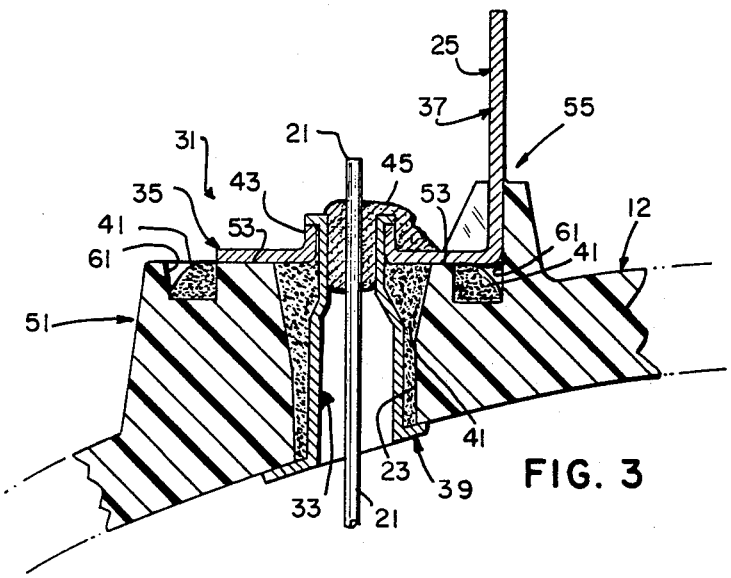
FIG. 3 is a partial side elevational view, in section, of the terminal means, excess adhesive accommodating means, and reflector depicted in FIG. 2.

With particular attention to FIGS. 2 and 3, there is shown a terminal means 31 for use in the invention. As stated, one terminal means is utilized to positively connect the support wire (which in turn is electrically connected to a respective one of the lead-in wires projecting from lamp capsule 13) to the vehicle's circuitry. It is, of course, understood that at least two support wires are utilized in each headlight and therefore a corresponding number of terminal means are preferably employed. It is further understood that in those headlights wherein three support wires are utilized for the lamp capsule component (dual beam variety), a corresponding number of terminal means are similarly utilized. Because these other terminal means are similar to that depicted in FIGS. 2 and 3, description other than that provided is not deemed necessary.

Terminal means 31 comprises a metallic (e.g., brass, aluminum, copper, steel, or nickel-iron alloy) eyelet member 33 which is positioned within the corresponding opening 23 through which support wire 21 passes. Terminal means 31 further includes a metallic (e.g., brass) lug member 25 having a base segment 35 and an upstanding leg segment 37 oriented at approximately ninety degrees to the base segment. Both segments 35 and 37 are of substantially flat configuration except for an upstanding, cylindrical shaped flange portion (43) formed in the center of the rounded end of base segment 35.

Assembly of the headlight is accomplished by inserting the metallic eyelet 33 upwardly through opening 23 from the inside of reflector 12. The head 39 of the eyelet is formed at an angle to the axis of the eyelet so as to approximately conform to the reflector's internal curvature. In turn, the body of eyelet 33 can be formed of two or more diameters (as shown), the larger one being formed to maintain concentricity with opening 23 and the smaller one being formed to maintain concentricity with the support wire 21 and to provide the correct diameter for subsequent setting (riveting) of the eyelet (described below). Metallic lug member 25 serves to provide electrical connection to the aforementioned external power source. The function of eyelet 33, therefore, is to maintain lug 25 securely in place and to provide a fixed point to which support wire 21 can be attached.

After eyelet 33 is inserted upwardly as described above, a quantity of a suitable adhesive 41 is applied in the annular area of opening 23 around the eyelet. Examples of suitable adhesives for use with the invention include a thermoplastic, thermoset or hot melt material. Examples of these include epoxies (epoxy resin), epoxy-urethanes, urethanes, polyesters, acrylics, synthetic rubbers, silicone rubbers, polyamides, phenolics, acrylates, polycarbonates, polystyrenes and silicone molding powders, to name a few. It is important that the amount of adhesive dispensed completely fill the opening about eyelet 33 to provide an effective seal.

With eyelet 33 in position and a liberal amount of the described adhesive located thereabout, lug 25 is then lowered to surround the upwardly projecting, smaller end of the eyelet. As such, this upper end of the eyelet is originally of a straight, cylindrical configuration. To accommodate this end, the base segment 35 of lug 25 includes the aforementioned upstanding annular flange portion 43 which includes an inner diameter slightly larger than the external diameter for the upper, cylindrical end of eyelet 33. With the lug in position, the uppermost end of the eyelet is spun, flattened, or peened over onto the flange 43 in the manner depicted in FIG. 3. This technique is often defined as riveting and occurs while the described adhesive remains in paste-like or semi-liquid form. As a result of the above operation, the upward end portion of eyelet 33 is mechanically secured and electrically connected to the base segment of eyelet 35 at a position located a spaced distance from leg segment 37.

Subsequent to the above operation, solder is applied to electrically connect the upstanding support wire 21 and eyelet 33. One example of suitable solder is a 60/40 tin-lead composition, although a 20/80 tin-lead composition will also suffice. To further enhance the electrical connection at this location of the invention, excessive solder is preferably utilized to flow over and make contact with the base segment 35. This overflow is shown to the right of flange portion 43 in FIG. 3. The above operations are performed preferably for each of the above support wires utilized in the invention.

There is provided within the curved rear portion of reflector 12 an upstanding portion 51 located about and relative to each corresponding opening 23 through which one of the support wires 21 passes. Upstanding portion 51 forms an integral part of the reflector's rear portion and includes an upper, flat surface 53 of substantially annular configuration and designed for having the rounded part of base segment 35 positioned thereon in a substantially flush arrangement. In addition, upper portion 51 includes a retaining flange portion 55 for engaging opposing sides of upstanding leg segment 37 to thus prevent displacement thereof relative to the location where eyelet 33 and base segment 35 are crimped. As can be seen in FIG. 2, such movement would be in a pivotal direction relative to this common point which in turn could result in such displacement of the leg segment so as to render subsequent connection impossible between the leg segment and a fixed electrical connector forming part of the vehicle's electrical system. As stated, the retaining flange portion 55 engages opposite sides of leg segment 37, and is preferably of a substantially U-shaped configuration so as to house the lower part of leg 37 and mating part of base 35 therein. Lug 25 is thus firmly held in at least a three point form of retention. As has been shown and described, this means of retaining lug 25 also substantially prevents tilting of the segment relative to the pivotal location. The direction for such tilting, if possible, is represented by the arrow "A" in FIG. 2. Rotational movement also prevented by upstanding portion 51 is depicted by the directional arrows "$R_1$" and "$R_2$" (FIG. 2).

For reasons indicated above, an excessive amount of the described adhesive 41 is employed to surround eyelet 33 during the above sealing operation and is therefore present when lug 25 is lowered and secured to the eyelet. To prevent any possible accumulation of this material on the external surfaces (those other than the upper surface of upstanding portion 51) of reflector 12, there is provided within the upper surface of upstanding portion 51 a reservoir 61 of substantially annular configuration which surrounds opening 23 and is designed for having excessive adhesive 41 collect therein. This material can be seen in FIGS. 2 and 3, and is forced into reservoir 61 when lug 25 is lowered about eyelet 33 and the base segment thereof engages surface 53. The head 39 of eyelet 33 is designed for preventing passage of adhesive to the interior of the reflector. Reservoir 61, as shown, comprises a groove (or slot) of sufficient depth to collect even the greatest amounts of excess material that may be typically used during assembly of the headlight and therefore prevents this material from engagement with the remaining surfaces of the reflector, as well as the upper surfaces of lug 25. It cannot, therefore, interfere with the described subsequent solder application. Reservoir 61 is also located immediately adjacent the portion of flat upper surface 53 on which base segment 35 rests.

There has thus been shown and described a new and unique means whereby accumulation of excessive quantities of sealing adhesive is accomplished during manufacture of a motor vehicle headlight which uses plastic reflector and mating lens components. This unique means of accumulation has been provided by forming an upstanding portion within the rear of the plastic reflector during formation (e.g., injection molding) thereof, said portion including the defined reservoir therein. Because of this, any increased cost of making the reflector using the invention is minimal. In addition, the invention is understandably ideally suited for mass production.

While there have been shown and described what are at present considered the preferred embodiments of the invention, it will be obvious to those skilled in the art that various changes and modifications may be made therein without departing from the scope of the invention as defined by the appended claims.

What is claimed is:

1. A motor vehicle headlight comprising:

a plastic reflector having a curved rear portion having at least one opening therein, and a forward open end portion;

a lens member secured to said open end portion of said reflector to provide a closure therefor;

an electrical lamp disposed within said reflector and including a glass envelope, at least two lead-in wires projecting from said envelope, and at least two support wires, each of said wires being fixedly secured to a respective one of said lead-in wires and passing through said rear portion of said plastic reflector, at least one of said wires being positioned within said opening within said rear portion;

terminal means for being electrically connected to said support wire positioned within said opening, said terminal means including a metallic eyelet located within said opening and substantially surrounding said support wire within said opening, and a metallic lug member including a base segment and an upstanding leg segment, said eyelet being secured to said base segment of said lug;

a quantity of adhesive located within said opening and surrounding said eyelet, said curved rear portion of said reflector including an upstanding portion located on an external surface of said reflector and about said opening having said eyelet, support wire, and adhesive therein, said upstanding portion defining a reservoir therein relative to said opening for accommodating excessive amounts of adhesive which may occur during assembly of said headlight, said reservoir comprising a substantially annular groove formed within said upstanding portion of said reflector and substantially surrounding said opening within said reflector.

2. The motor vehicle headlight according to claim 1 wherein the number of said support wires, said terminal means, and said openings within said rear portion of said plastic reflector is two, each of said support wires being positioned within a respective one of said openings, each of said terminal means electrically connected to a respective one of said support wires, said curved rear portion of said reflector including one of said upstanding portions located about each of said openings and having therein one of said reservoirs for accommodating excessive amounts of said adhesive.

3. The motor vehicle headlight according to claim 1 wherein the number of said support wires, said terminal means, and said openings within said rear portion of said plastic reflector is three, each of said support wires being positioned within a respective one of said openings, each of said terminal means electrically connected to a respective one of said support wires, said curved rear portion of said reflector including one of said upstanding portions located about each of said openings and having therein one of said reservoirs for accommodating excessive amounts of said adhesive.

4. The motor vehicle headlight according to claim 1 wherein said electric lamp is a tungsten halogen lamp.

5. The motor vehicle headlight according to claim 1 wherein said upstanding portion includes an upper surface thereon having said base segment of said lug member positioned thereon, said annular groove located within said upstanding portion adjacent to and substantially about said upper surface.

* * * * *